US007036988B2

(12) United States Patent
Olechowski

(10) Patent No.: US 7,036,988 B2
(45) Date of Patent: May 2, 2006

(54) ZIPPER FOR VACUUM STORAGE BAG

(75) Inventor: Kevin P. Olechowski, Bourbonnais, IL (US)

(73) Assignee: Illinois Tool Works Inc., Glenview, IL (US)

( * ) Notice: Subject to any disclaimer, the term of this patent is extended or adjusted under 35 U.S.C. 154(b) by 104 days.

(21) Appl. No.: 10/370,310

(22) Filed: Feb. 19, 2003

(65) Prior Publication Data

US 2004/0161178 A1 Aug. 19, 2004

(51) Int. Cl.
*B65D 33/16* (2006.01)

(52) U.S. Cl. ..... 383/210.1; 383/61.2; 383/63; 383/103; 383/59; 383/210

(58) Field of Classification Search ..... 383/61.2, 383/63, 210–211, 93, 95, 100, 103, 59
See application file for complete search history.

(56) References Cited

U.S. PATENT DOCUMENTS 4,709,396 A * 11/1987 Voshall et al. ..... 383/5
4,709,397 A * 11/1987 Voshall et al. ..... 383/5
4,759,642 A * 7/1988 Van Erden et al. ..... 383/210.1
4,832,505 A * 5/1989 Ausnit et al. ..... 383/5
5,492,411 A 2/1996 May
5,540,500 A * 7/1996 Tanaka ..... 383/43
5,701,996 A * 12/1997 Goto et al. ..... 206/287
5,839,582 A * 11/1998 Strong et al. ..... 206/524.8
6,231,236 B1 * 5/2001 Tilman ..... 383/61.2
6,273,607 B1 * 8/2001 Buchman ..... 383/5
6,308,498 B1 10/2001 Malin et al.
6,341,688 B1 * 1/2002 Graham ..... 206/63.5
6,350,058 B1 2/2002 Linton
6,360,513 B1 * 3/2002 Strand et al. ..... 53/412
6,604,634 B1 * 8/2003 Su ..... 206/524.8
6,691,383 B1 * 2/2004 Linton ..... 24/585.12

* cited by examiner

*Primary Examiner*—Jes F. Pascua
(74) *Attorney, Agent, or Firm*—Ostrager Chong Flaherty & Broitman P.C.

(57) ABSTRACT

A reclosable vacuum storage bag having a zipper that can be hermetically sealed after the zipper is closed and before the bag is evacuated. The hermetic seal can be provided by means of a pressure-sensitive adhesive coating on one of the two zipper strips or by means of a pair of cohesive coatings on confronting portions of the respective zipper strips. The coating or coatings run the entire length of the bag mouth.

7 Claims, 5 Drawing Sheets

PRODUCT SIDE

PRODUCT SIDE

ZIPPER FOR VACUUM STORAGE BAG

BACKGROUND OF THE INVENTION

This invention generally relates to storage bags that have means for evacuation. In particular, the invention relates to evacuable storage bags that are reclosable by means a plastic zipper.

Reclosable plastic zippers are useful for sealing thermoplastic pouches or bags. Typically, the plastic zippers include a pair of interlockable fastener elements, or profiles, that form a closure. The profiles in plastic zippers can take on various configurations, e.g. interlocking rib and groove elements having so-called male and female profiles, interlocking alternating hook-shaped closure elements, etc.

For many packaged products, it is desirable to provide means for hermetically sealing the package. For example, it is known to provide a frangible hermetic seal in an unopened reclosable package that contains perishable material, such as foodstuff. However, once the frangible hermetic seal is broken and the package opened, the hermetic seal cannot be restored when the package is reclosed.

It is also known to store articles of manufacture, such as clothing, in evacuated storage bags having a reclosable zipper. In the case of reclosable storage bags that are evacuated after filling, it is desirable that the reclosed bag be hermetically sealed. Such a hermetic seal must be provided by the plastic zipper. Since it is desirable that such storage bags be reusable, it should be apparent that a one-time frangible hermetic seal is unsuitable. There is a need for an improved zipper design that can provide vacuum-tight sealing of an evacuable storage bag that can be reused many times.

BRIEF DESCRIPTION OF THE INVENTION

The invention is directed to a reclosable vacuum storage bag having a zipper that can be hermetically sealed after the zipper is closed and before the bag is evacuated. The hermetic seal can be provided by means of a pressure-sensitive adhesive coating on one of the two zipper strips or by means of a pair of cohesive coatings on confronting portions of the respective zipper strips. The coating or coatings run the entire length of the bag mouth.

One aspect of the invention is a package comprising: a receptacle comprising first and second walls having upper portions that form a mouth; a valve penetrating one of those walls and operable to allow the evacuation of air from the interior of the receptacle; a zipper comprising first and second mutually interlockable zipper parts joined at opposite ends of the zipper, the first zipper part being joined to or integrally formed with the upper portion of the first wall, and the second zipper part being joined to or integrally formed with the upper portion of the second wall; and a hermetic seal disposed between the first and second zipper parts for hermetically sealing the mouth. The hermetic seal comprises a coating covering a longitudinal area on a surface of one of the zipper parts, which longitudinal area extends the length of the mouth.

Another aspect of the invention is a zipper strip comprising a base strip extending in a longitudinal direction, a closure profile integrally formed with and projecting from one side of the base strip and extending longitudinally, and a coating covering a longitudinal area on the aforementioned one side of the base strip, wherein the coating comprises a material selected from the group including pressure-sensitive adhesive materials and cohesive materials.

A further aspect of the invention is a package comprising: a receptacle comprising first and second walls having upper portions that form a mouth; a valve penetrating one of the first or second walls and operable to allow the evacuation of air from the interior of the receptacle; and a zipper comprising first and second mutually interlockable zipper strips joined at opposite ends of the zipper. The first zipper strip comprises a first base strip having one side joined to an upper margin of the first wall, a first closure profile projecting from the other side of the first base strip, the first closure profile extending longitudinally along the first base strip, and a coating covering a longitudinal area on the other side of the first base strip, wherein the first coating comprises a material selected from the group including pressure-sensitive adhesive materials and cohesive materials; and the second zipper strip comprises a second base strip having one side joined to an upper margin of the second wall, and a second closure profile projecting from the other side of the second base strip, the second closure profile extending longitudinally and being interlockable with the first closure profile.

Yet another aspect of the invention is a storage device comprising: a bag having an interior that communicates with the exterior of the bag via a mouth; a zipper comprising first and second interlockable profiled zipper strips joined to the mouth of the bag, the mouth being open when the zipper is in an opened state and closed when the zipper is in a closed state; a layer of pressure-sensitive adhesive material attached to the first zipper strip along a zone that extends the full length of the mouth, the pressure-sensitive adhesive material being in contact with a confronting zone of the second zipper part to hermetically seal the zipper in the closed state; and a valve that penetrates the bag and is operable to enable the evacuation of air from the bag interior when the zipper is hermetically sealed in the closed state.

A further aspect of the invention is a storage device comprising: a bag having an interior that communicates with the exterior of the bag via a mouth; a zipper comprising first and second interlockable profiled zipper strips joined to the mouth of the bag, the mouth being open when the zipper is in an opened state and closed when the zipper is in a closed state; a first layer of cohesive material attached to the first zipper strip along a zone that extends the full length of the mouth; a second layer of cohesive material attached to the second zipper strip along a zone that extends the full length of the mouth, the first and second layers of cohesive material being in contact with each other to hermetically seal the zipper in the closed state; and a valve that penetrates the bag and is operable to enable evacuation of air from the bag interior when the zipper is hermetically sealed in the closed state.

Yet another aspect of the invention is a method of manufacturing a zipper part for use in reclosable packaging, comprising the steps of: extruding a zipper part comprising a base strip and a closure profile projecting from one side of the base strip; and applying a layer of pressure-sensitive adhesive or cohesive material of predetermined width onto the one side of the base strip. The layer extends longitudinally in parallel with said closure profile.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
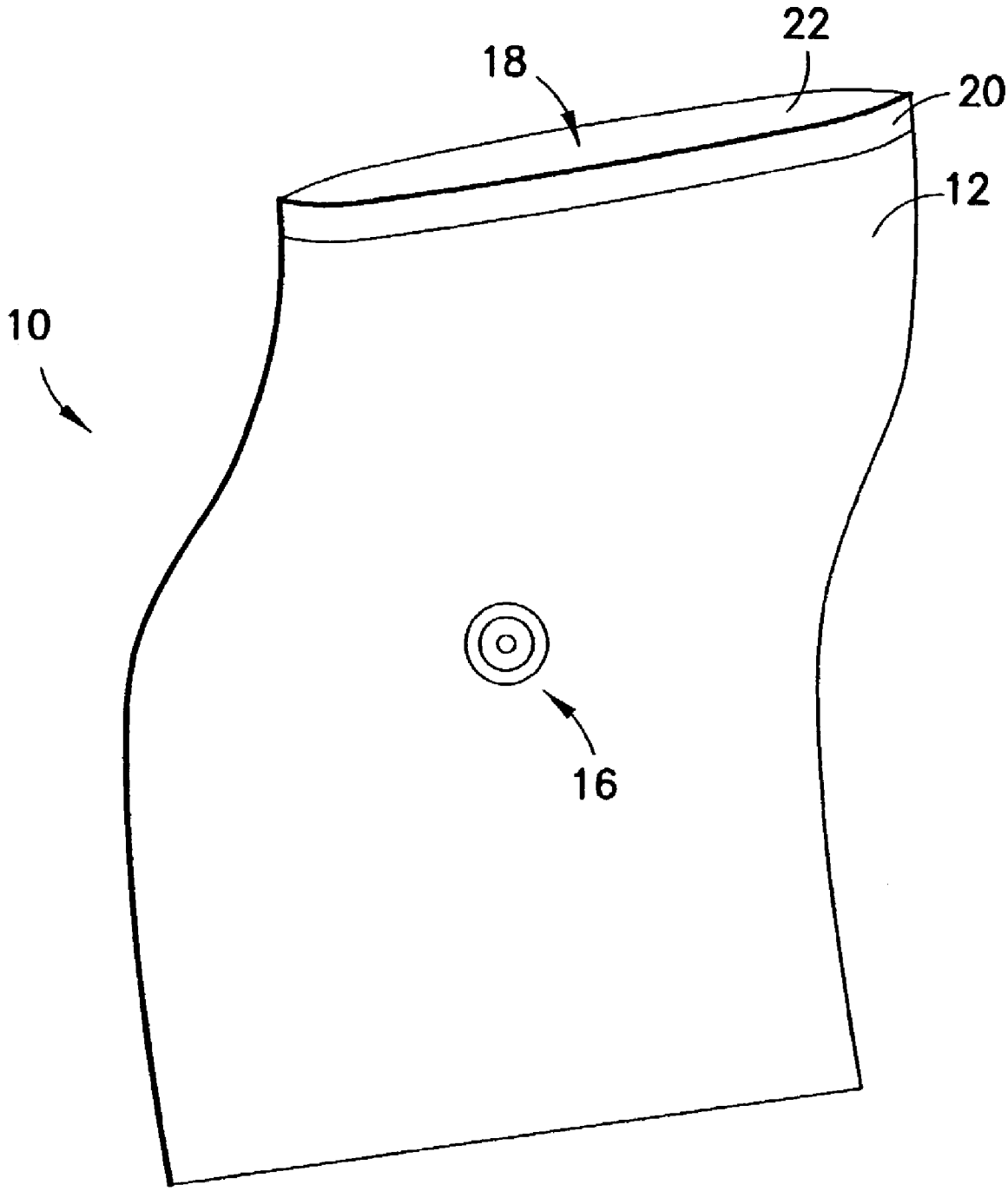
FIG. 1 is a drawing showing a front view of an evacuable storage bag having a valve and a zipper that can be hermetically sealed.

FIG. 1 is a generalized depiction of an evacuable storage bag 10 that comprises a front wall 12 and a rear wall (not visible in FIG. 1) formed by folding a sheet of bag-making film and then heat sealing the side edges of the front and rear walls to form a receptacle having an open mouth 18. Prior to folding, a valve assembly 16 is attached through an aperture formed in the sheet of bag-making film. Also a zipper assembly is attached to the film. This can be done in numerous ways. For example, one zipper part 20 could be attached to one margin of the film and then the web of film is folded. After folding, a margin of the folded-over portion of the film is attached to the other part 22 of the zipper assembly. Alternatively, a closed zipper assembly is placed between the opposing margins of a folded web and both zipper parts are sealed to the web in one operation. In either case, after zipper attachment, the side edges of the overlapping portions of bag-making film are heat sealed to form bag side seals. The ends of the zipper parts 20 and 22 can be crushed and fused together to form a zipper with joined ends. This operation can be performed in an operation separate from the side sealing operation.

Figure 3:
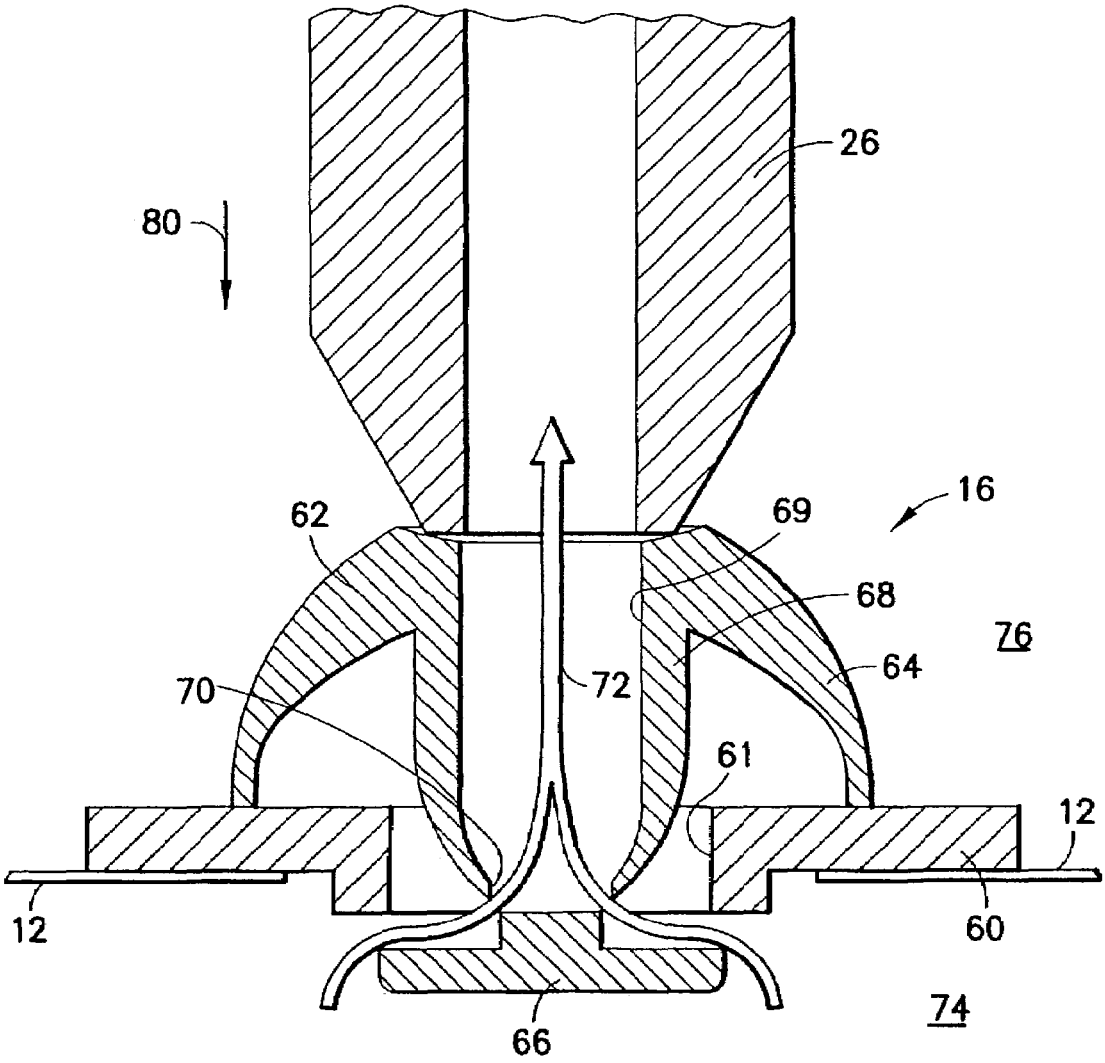
FIG. 3 is a drawing showing a sectional view of a valve assembly suitable for incorporation in the storage bags disclosed herein.

The valve assembly 16 is mounted in the front wall 12 so that an airtight seal is formed between the periphery of the valve assembly and the adjacent and surrounding peripheral edge of the aperture in the film. Any suitable valve assembly may be used. One example of a suitable valve assembly 16 is shown in FIG. 3. That valve assembly comprises a base 60 having a hole 61 therethrough and a contact surface disposed along a periphery of the hole, and further comprises a valve 62 coupled to the base for opening the hole in a first state and closing the hole in a second state. The valve 62 comprises a resilient cap 64 disposed on one side of the base 60, a gate 66 disposed on the other side of the base 60, and a stem 68 connecting the cap 64 to the gate 66. The cap 64 has an opening, the stem 68 has a cavity 69 in fluid communication with the opening in the cap 64 and at least one opening 70 in fluid communication with the cavity and an exterior of the stem 68, and the gate 66 is configured to contact the contact surface of the base 60 to close the hole 61 in the base when the cap 64 is in a first, i.e., undeformed, state and to separate at least partially from the surface to open the hole 61 in the base 60 at least partially when the cap 64 is in a second, i.e., deformed, state. When the cap 64 is deformed, the opening in the cap is in fluid communication with a space on the other side of the base 60 via the cavity 69 and the openings 70 in the stem.

Figure 2:
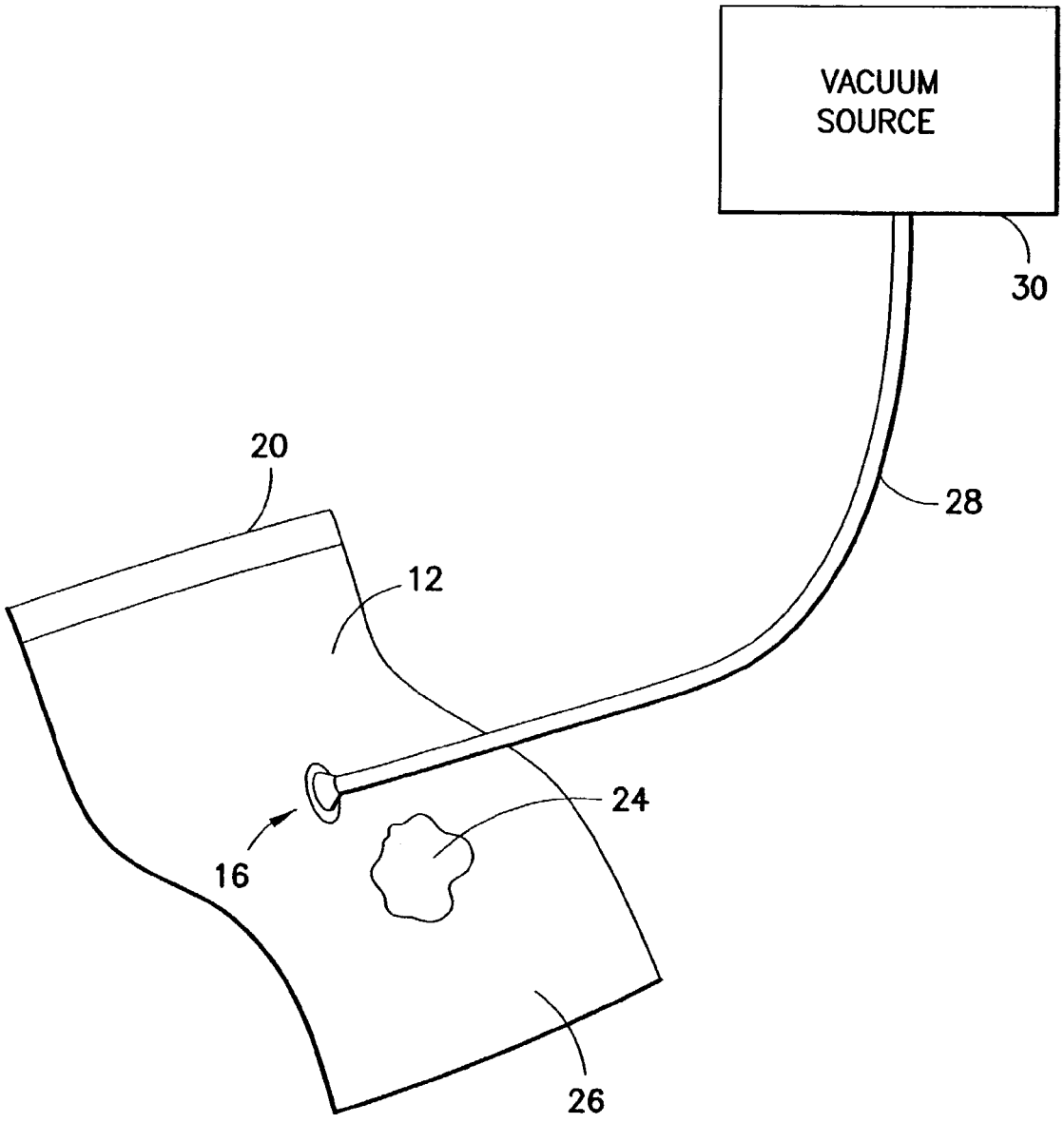
FIG. 2 is a drawing showing the storage bag of FIG. 1 connected to a vacuum source.

Still referring to FIG. 3, the deformation of cap 64 is achieved by pressing the tip of a nozzle 26 against the cap of valve assembly 16 (in the direction indicated by arrow 80), causing the gate 66 to separate from the base 60, thereby allowing fluid communication between the interior 74 and the exterior 76 of the bag. As seen in FIG. 2, the nozzle 26 is connected to an exhaust port of a vacuum source 30 (e.g., a vacuum pump) by means of a flexible tube 28. During evacuation, the interior of the bag is in fluid communication with the vacuum source 30 via the open valve 62 of the valve assembly 16, the nozzle 26 and the flexible tube 28 connected in series. When the valve 62 is open, the vacuum source 30 draws air from the interior 74 of the bag (indicated by arrow 72 in FIG. 3), thereby forming a vacuum inside the bag. FIG. 2 shows an item 24 stored inside the evacuated package. The stored item may be clothing, a book, or any other item that is best stored in an environment that will not expose the item to air or moisture. Also, evacuation allows the user to compress clothing or blankets to save space in storage.

The bag-making film may be made of any air-impermeable material, such as polyethylene or nylon/polyethylene laminate. The components of the valve assembly may be formed by conventional injection molding, and may be formed of material such as polyethylene, polyvinylchloride, acrylonitrile-butadiene-styrene or other suitable material.

When the nozzle 26 is removed from the cap of the valve assembly 16, the cap recovers its undeformed shape (not shown in FIG. 3). The resilient force exerted by the cap 64 pulls the gate 66 upwards against the base 60, again forming an airtight seal.

Figure 4:
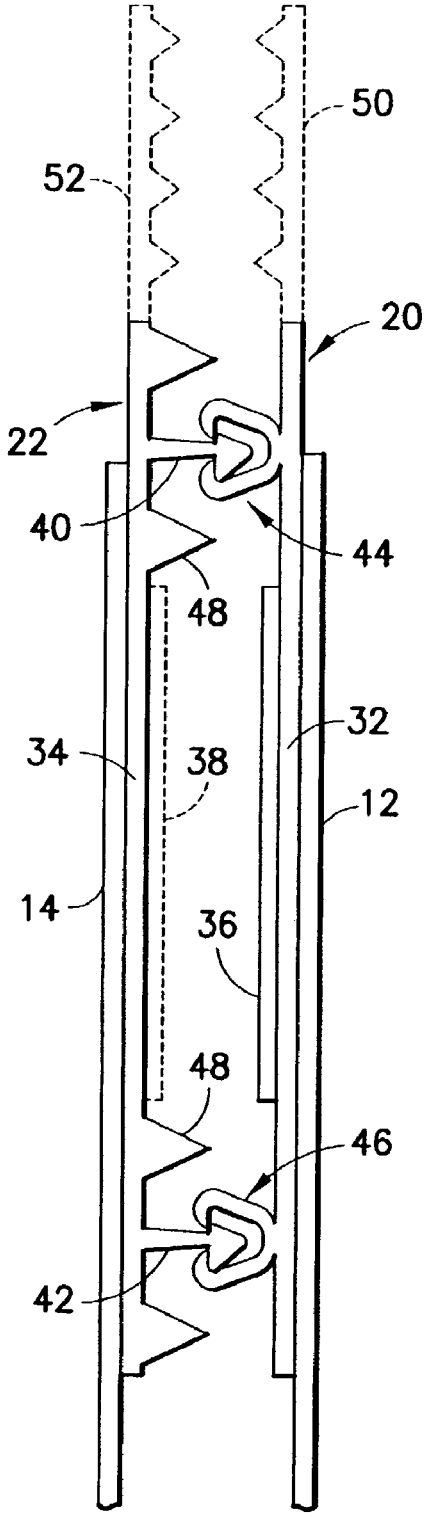
FIG. 4 is a drawing showing a sectional view of a zipper assembly in accordance with one embodiment of the invention. Hatching has not been inserted in order to avoid clutter that would distract the reader's attention from the structure of the assembly.

In order to maintain a vacuum inside the bag, however, it is necessary that the zipper of the reclosable bag also be hermetically sealed. The present invention is directed to structures for hermetically sealing the zipper. One embodiment of a hermetically sealed zipper suitable for use in a vacuum storage bag is depicted in FIG. 4. It should be appreciated that this zipper is not drawn to scale. For example, the ratio of the width of the base strip to the thickness of the base strip may be greater than the ratio one would derive from measurement of the drawing.

As seen in FIG. 4, a package in accordance with this first embodiment comprises a receptacle comprising a front wall 12 and a rear wall 14. The upper marginal portions of walls 12 and 14 form a mouth of the receptacle. Although not shown in FIG. 4, a valve assembly (e.g., of the type shown in FIG. 3) penetrates the front wall 12. The valve assembly is operable (in the manner previously described) to allow the evacuation of air from the interior of the receptacle.

An extruded plastic zipper is installed in the mouth of the package. The zipper comprises a pair of interlockable fastener strips or zipper halves 20 and 22. In general, the interlocking profiles of the zipper halves may take any form. For example, the zipper may comprise interlocking rib and groove elements or alternating hook-shaped closure elements. Closure profiles of the rib-and-groove variety are used in the embodiment shown in FIG. 4. The rib may having any profile that can be retained by the opposing lips at the mouth of the groove, e.g., triangular, trapezoidal, semicircular, and so forth. As shown in FIG. 4, zipper part 20 comprises a base strip 32 and a pair of female closure profiles 44 and 46 that are mutually parallel and spaced apart, while zipper part 22 comprises a base strip 34 and a pair of male closure profiles 40 and 42 that are received in and interlock with the female closure profiles 44 and 46 respectively. The zipper part 22 is further provided with two pairs of ribs 48, the ribs of each pair flanking a respective male closure profile. The ribs 48 prevent bending of the male closure profiles when the zipper part is passed through the nip of two rollers during automated manufacturing operations. The preferred zipper material is polyethylene. However, a different plastic material, such as polypropylene, could be used. Although not shown in FIG. 4, the zipper parts 20 and 22 are joined at opposite ends of the zipper, for example, by fusing the confronting ends of the zipper parts together by application of heat. Optionally, the ends of the zipper base strips are extended on the consumer side of the package to provide gripping strips 50 and 52, indicated by dashed lines in FIG. 4. Each gripping strip may be provided with a plurality of mutually parallel, spaced-apart ribs that facilitate gripping of the ends of the strips by the consumer. The consumer can then grasp the gripping strips 50 and 52 and then pull them apart to pry open the zipper.

The zipper part 20 is joined to the upper marginal portion of the front wall 12, and the zipper part 22 is joined to the upper marginal portion of the rear wall 14, e.g. by means of respective layers of sealant material (not shown in FIG. 4) laminated to the backs of the base strips. This is typically accomplished by co-extruding the zipper part and the sealant layer. The front and rear bag wall panels are respectively sealed to the zipper halves by heat fusion or welding (also referred to as "heat sealing"). Alternatively, the interlockable zipper halves can be attached to the wall panels by adhesive or bonding strips or the zipper profiles can be extruded integrally with the bag material. The walls of the bag may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

The zipper shown in FIG. 4 further comprises means for hermetically sealing the zipper. FIG. 4 shows two embodiments. In one embodiment, the hermetic sealing means comprise a layer 36 of pressure-sensitive adhesive material applied on base strip 32 as a coating on a central zone between the female profiles 44 and 46 (for this embodiment, ignore the layer 38 indicated by dashed lines). A pressure-sensitive adhesive is an adhesive that develops maximum bonding power when applied by a light pressure. The pressure-sensitive coating is applied to a portion of the zipper part that has been subjected to a corona treatment to enhance coating adhesion. The pressure-sensitive adhesive coating is continuously applied along the entire length of the zipper part 20. Although not shown in FIG. 4, the hermetic seal is achieved by pressing the base strips 32 and 34 together along the entire length of the central region between the closure profiles. When sufficient pressure is applied, the pressure-sensitive adhesive coating 36 will adhere to the confronting central region of the base strip 34 (this hermetically sealed state is not shown in FIG. 4), forming a hermetic seal along the entire length of the mouth of the package. When the zipper parts 20 and 22 are later pulled apart, the pressure-sensitive adhesive coating will peel away from the base strip 34 and will remain on the base strip 32. Alternatively, the pressure-sensitive adhesive coating could be applied on base strip 34 instead of base strip 32. The functionality of the hermetic seal would be the same in either case.

In accordance with an alternative embodiment of the invention, the hermetic sealing means comprise a layer 36 of cohesive material applied on base strip 32 as a coating on a central zone between the female profiles 44 and 46, and a layer 38 (indicated by dashed lines in FIG. 4) of cohesive material applied on base strip 34 as a coating on a central zone between the male profiles 40 and 42. A cohesive material is a tacky material that sticks with greater cohesive strength to itself than to other materials. The cohesive coatings are applied to portions of the zipper parts that have been subjected to a corona treatment to enhance coating adhesion. The cohesive coatings are continuously applied along the entire length of the zipper parts 20 and 22. Again, the hermetic seal is achieved by pressing the base strips 32 and 34 together along the entire length of the central region between the closure profiles. The coating 36 will cohere to the coating 38 (this cohesive state is not shown in FIG. 4), forming a hermetic seal along the entire length of the mouth of the package. When the zipper parts 20 and 22 are later pulled apart, the cohesive coatings will peel away from each other.

Figure 5:
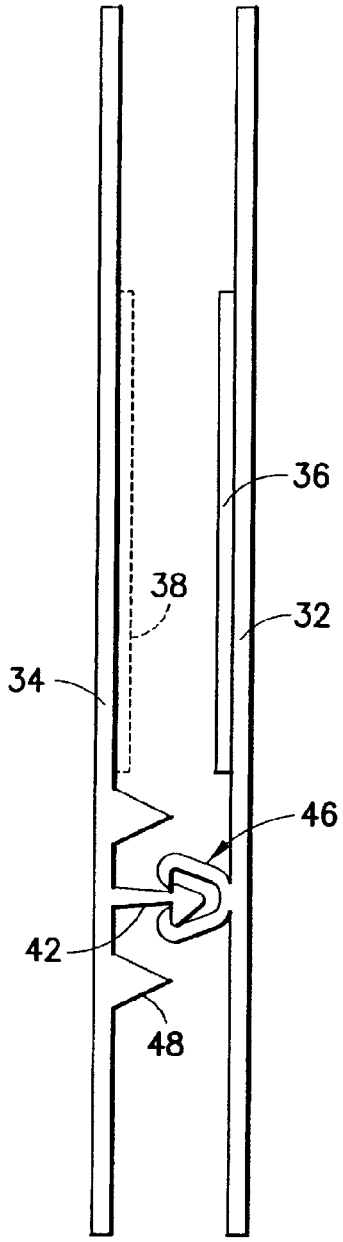
FIGS. 5–7 are drawings showing sectional views of zipper assemblies in accordance with other embodiments of the invention.

To practice the present invention, it is not necessary to provide interlocking zipper profiles on both sides (i.e., the product side and the consumer side) of the hermetic seal. For example, the interlocked zipper profiles on the consumer side of the hermetic seal (profiles 40 and 44 in FIG. 4) can be eliminated, as seen in FIG. 5. In this case, the hermetic seal is disposed on the consumer side of the zipper profiles. The remaining elements bearing the same reference numerals used in FIG. 4 have the same functionality previously described.

In accordance with a further alternative embodiment not shown in the drawings, the interlocked zipper profiles on the product side of the hermetic seal (profiles 40 and 44 in FIG. 4) can be eliminated. In the latter case, the hermetic seal is disposed on the product side of the zipper profiles.

Figure 6:
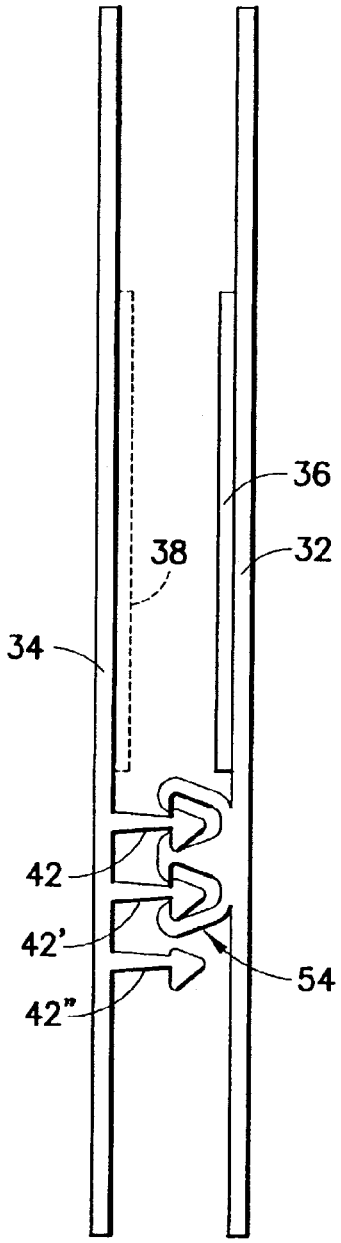

FIG. 6 shows an embodiment similar to the embodiment of FIG. 5, but having different zipper profiles. This embodiment employs a so-called "variable alignment" zipper. In this example, one zipper part comprises a trio of male closure profiles 42, 42' and 42", while the other zipper part comprises a dual female closure profile 54 having two grooves for receiving two of the three male closure profiles. As seen in FIG. 6, the male closure profiles 42 and 42' can be inserted in respective grooves formed in part by a common central leg with oppositely directed detents and by respective outer gripper jaws that cooperate with the central leg. Alternatively, full interlocking of the zipper profiles could be achieved by inserting male closure profiles 42' and 42" in the respective grooves of the dual female closure profile 54.

Figure 7:
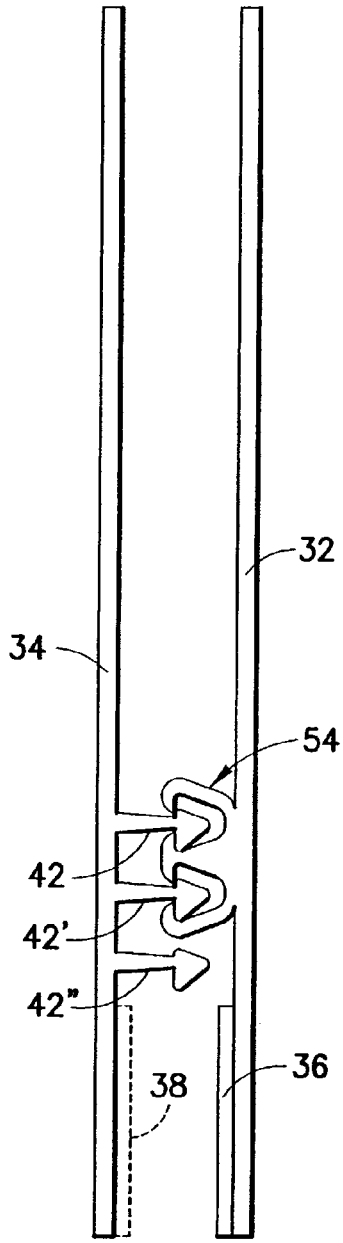

In FIG. 6 (as in FIG. 5), the hermetic sealing means (one or both of coating 36 and 38) are applied to the zipper base strips 32 and 34 on the consumer side of the zipper profiles. In contrast, FIG. 7 shows an alternative embodiment wherein the hermetic sealing means are applied on the product side of the zipper profiles. The embodiment shown in FIG. 7 has a variable alignment zipper identical to that shown in FIG. 6.

In each of the embodiments shown in FIGS. 5–7, spaced ribs may provided on the distal portions of the zipper base strips, such ribbed distal portions serving as gripping strips of the type described with reference to FIG. 4.

A zipper part having a coating made of pressure-sensitive adhesive or cohesive material may be manufactured by co-extruding the zipper part to have a sealant layer on the exterior side, applying a corona treatment on the interior side of the zipper part, and then pulling the zipper part through a coater that applies a layer of pressure-sensitive adhesive or cohesive material of predetermined width onto the corona-treated side of the moving zipper part. The extruded zipper part comprises a base strip and a closure profile projecting from one side of the base strip. The coating is applied on a generally planar surface that extends longitudinally beside and in parallel with the closure profile. The corona treatment increases the adhesion of the coating to the zipper part, while the sealant layer facilitates joinder of the zipper part to the bag-making film.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

The invention claimed is:

1. A package comprising:

a receptacle comprising first and second walls having upper portions that form a mouth;

a valve penetrating one of said first or second walls and operable to allow the evacuation of air from the interior of said receptacle;

a zipper comprising first and second mutually interlockable zipper parts joined at opposite ends of said zipper, said first zipper part being joined to or integrally formed with said upper portion of said first wall, and said second zipper part being joined to or integrally formed with said upper portion of said second wall; and a peelable hermetic seal disposed between said first and second zipper parts for hermetically sealing said mouth, wherein said hermetic seal comprises a first coating covering a longitudinal area on a surface of said first zipper part, said longitudinal area extending the length of said mouth, said first coating being in contact with either a surface of said second zipper part or a second coating on said surface of said second zipper part, said first coating remaining on said surface of said first zipper part and peeling apart from said surface of said second zipper part or said second coating thereon when said first and second zipper parts are separated in the region of said hermetic seal to unseal said hermetic seal, wherein said first zipper part comprises first and second interlockable means, and said second zipper part comprises third and fourth interlockable means that are respectively interlockable with said first and second interlockable means, said second and fourth interlockable means being located on a consumer side of said first and third interlockable means, and said first coating is disposed between said first and second interlockable means.

2. The package as recited in claim 1, wherein said first coating comprises a layer of pressure-sensitive adhesive material.

3. The package as recited in claim 1, wherein said hermetic seal further comprises said second coating covering a longitudinal area on said surface of said second zipper part, said second coating being disposed between said first and third interlockable means and in contact with said first coating.

4. The package as recited in claim 3, wherein each of said first and second coatings comprises a respective layer of cohesive material.

5. A package comprising:

a receptacle comprising first and second walls having upper portions that form a mouth;

a valve penetrating one of said first or second walls and operable to allow the evacuation of air from the interior of said receptacle; and a zipper comprising first and second mutually interlockable zipper strips joined at opposite ends of said zipper, said first zipper strip comprising a first base strip having one side joined to an upper margin of said first wall, a first closure profile projecting from the other side of said first base strip, said first closure profile extending longitudinally along said first base strip, and a first coating covering a longitudinal surface area on said other side of said first base strip, wherein said first coating comprises a material selected from the group including pressure-sensitive adhesive materials and cohesive materials; and said second zipper strip comprising a second base strip having one side joined to an upper margin of said second wall, and a second closure profile projecting from the other side of said second base strip, said second closure profile extending longitudinally and being interlockable with said first closure profile, wherein said first coating can be placed in contact with either a longitudinal surface area on said other side of said second base strip or a second coating on said longitudinal surface area on said other side of said second zipper part for hermetically sealing said mouth of said receptacle, said material having the property that said first coating remains on said longitudinal surface area on said other side of said first base strip and peels apart from said longitudinal surface area on said other side of said second base part or said second coating thereon when said first and second base strips are separated along said longitudinal surface areas to unseal said hermetic seal, and wherein said first zipper strip further comprises a third closure profile projecting from said other side of said first base strip parallel to and spaced apart from said first closure profile, said first coating being disposed between said first and third closure profiles, and said second zipper strip further comprises a fourth closure profile projecting from said other side of said second base strip parallel to and spaced apart from said second closure profile.

6. The package as recited in claim 5, wherein said second zipper strip further comprises said second coating covering said longitudinal surface area on said other side of said second base strip, wherein said second coating is disposed between said second and fourth closure profiles, and said first and second coatings are made of cohesive material.

7. A storage device comprising:

a bag having an interior that communicates with the exterior of said bag via a mouth;

a zipper comprising first and second interlockable profiled zipper strips joined to said mouth of said bag, said mouth being open when said zipper is in an opened state and closed when said zipper is in a closed state;

a layer of pressure-sensitive adhesive material attached to said first zipper strip along a zone that extends the full length of said mouth, said pressure-sensitive adhesive material being in contact with a confronting zone of said second zipper part to hermetically seal said zipper in said closed state, said confronting zones of said first and second zipper parts being separable in a manner whereby said layer of pressure-sensitive adhesive material peels away from said confronting zone of said second zipper part while said layer of pressure-sensitive adhesive material remains attached to said first zipper strip; and a valve that penetrates said bag and is operable to enable the evacuation of air from said bag interior when said zipper is hermetically sealed in said closed state, wherein said first zipper strip comprises first and second closure profiles, and said second zipper strip comprises third and fourth closure profiles that are respectively interlockable with said first and second closure profiles for closing said zipper, said layer of pressure-sensitive adhesive material being disposed between said first and second closure profiles.

* * * * *